US005090492A

United States Patent [19]

Keith

[11] Patent Number: 5,090,492

[45] Date of Patent: Feb. 25, 1992

[54] DRILL BIT WITH VIBRATION STABILIZERS

[75] Inventor: Carl W. Keith, Spring, Tex.

[73] Assignee: Dresser Industries, Inc., Dallas, Tex.

[21] Appl. No.: 654,249

[22] Filed: Feb. 12, 1991

[51] Int. Cl.[5] ..... E21B 10/46

[52] U.S. Cl. ..... 175/410

[58] Field of Search ..... 175/325, 327, 329-332, 175/409, 410

[56] References Cited

U.S. PATENT DOCUMENTS

| | | | |
|---|---|---|---|
| 4,602,691 | 7/1986 | Weaver | 175/410 X |
| 4,640,375 | 2/1987 | Barr et al. | 175/410 |
| 4,718,505 | 5/1988 | Fuller | 175/410 X |
| 4,889,017 | 6/1989 | Fuller et al. | 175/410 X |

OTHER PUBLICATIONS

S.P.E. Paper #19572, Oct. 1989.

*Primary Examiner*—Thuy M. Bui

*Attorney, Agent, or Firm*—Hubbard, Thurman, Tucker & Harris

[57] ABSTRACT

A rotary drill bit for drilling subterranean wells comprises a plurality of radially adjacent cutting elements disposed in angularly spaced relationship on the end face of the drill bit. Behind each set of cutting elements, at least one stabilizing projection is formed on the drill bit. Such projection is of peripherally elongated configuration and is circumferentially aligned with one of the cutting elements so as to snugly enter and engage the side walls of the formation groove produced by the aligned cutting element, thus providing substantial resistance against lateral displacement or vibration of the drill bit.

9 Claims, 2 Drawing Sheets

DRILL BIT WITH VIBRATION STABILIZERS

BACKGROUND OF THE INVENTION

1. Field of the Invention

The invention relates to a drill bit for drilling subterranean formations, and particularly to a drill bit construction that will provide stabilization of the drill bit against radial vibration.

2. Summary of the Prior Art

When drilling well bores in subsurface formations, it often happens that the drill passes readily through a comparatively soft formation and then strikes a significantly harder formation. Rarely do all of the cutting elements mounted on conventional drilling bit strike the harder formation at the same time, hence a substantial impact force is incurred by the one or two cutting elements that initially strike the harder formation, resulting in a sidewise deflecting force being applied to the entire drilling bit. The end result is the creation of radial vibration of the drilling bit relative to the axis of rotation, resulting in either an enlarged well bore or a well bore having axially spaced grooves in the bore wall. Substantial wear or even destruction of those cutting elements initially striking the harder formation is an additional problem.

The problem of vibration of a drilling bit is particularly acute when the well bore is drilled at a substantial angle to the vertical, such as in the recently popular horizontal drilling practice. Here, the drill bit and the adjacent portions of the drilling string are constantly subject to the downward force of gravity and a sporadic weight on bit, producing unbalanced loading of the cutting structure, which can result in radial vibration. Prior investigators of the effects of vibration on a drilling bit have developed the phraseology of "bit whirl" to describe the phenomena. See SPE Paper #19572 by T. M. WARREN et al entitled: "Development of a Whirl-Resistant Bit". The only viable solution proposed by this investigation was the utilization of a low friction gauge pad on the drill bit, but the writers admit that this technology is still being refined. It follows that a practical preventive solution to the problem of vibration of a drilling bit would be highly desirable, particularly for use in directional drilling of wells.

SUMMARY OF THE INVENTION

A drill bit embodying this invention comprises a bit body having the customary shank portion for connection to the drill string. The end face of the bit body is of the conventional spherical segment configuration, either convex or concave, or may comprise a radial surface or a conical surface. The end face of the bit body is preferably provided with three angularly spaced, axially inwardly extending bores for the supply of drilling mud to the cutting elements. In a preferred embodiment, three sets of cutting elements are mounted on the end face extending from a central region of the end face radially outwardly to the periphery of the end face with each set of cutting elements respectively disposed intermediate the three drilling fluid bores.

Immediately behind each set of primary cutting elements there is provided at least one stabilizing projection which is integrally formed on the end face and has a peripherally elongated configuration and a rounded external non-cutting surface in a radial plane cross-section. Each of the stabilizing projections is circumferentially aligned behind one of the cutting elements so that the formation groove produced by that particular cutting element is snugly engaged by the surface area of the stabilizing projection. This necessarily means that a significant portion of the external surface of the stabilizing projection has a constant snug engagement with the side walls of the groove cut by the particular cutting element with which the stabilizing projection is circumferentially aligned.

In a preferred embodiment of the invention, two such stabilizing projections are provided on the end face of the drill bit for each set of cutting elements and these are respectively disposed immediately behind two of the cutting elements of each set of primary cutting elements. Additionally, sets of secondary cutting elements, preferably three sets, are mounted on the end face of the drill bit at a position exteriorly of the drill bit bores and respectively intermediate the three sets of primary cutting elements. At least one stabilizing projection is provided behind each set of secondary cutting elements and these stabilizing projections have the same configuration and circumferential alignment with a respective secondary cutting element as was previously described for the stabilizing projections located behind the primary cutting elements. Where space permits, two or more stabilizing projections can be provided behind two or more of the secondary cutting elements in respective circumferential alignment.

The sidewalls of the drill bit are provided with any conventional array of reaming or gauging cutters such as angularly spaced, vertical aligned rows of PDC cutting elements The particular cutter configuration employed on the sidewalls of the bit forms no part of the present invention.

With the aforedescribed construction, the stabilizing projections follow the same path as the respective cutting elements with which they are circumferentially aligned and snugly engage the side walls of the formation grooves cut by said respective projections. Since no cutting elements are mounted on the stabilizing projections, the bit is at all times secured against lateral displacement due to impact loading produced by hitting a harder formation or resulting from the unbalanced forces involved in directional drilling, and in particular, horizontal drilling.

Other advantages of the invention will be readily apparent to those skilled in the art from the following detailed description, taken in conjunction with the annexed sheets of drawings, on which is shown several embodiments of the invention.

DESCRIPTION OF PREFERRED EMBODIMENTS

Figure 2:
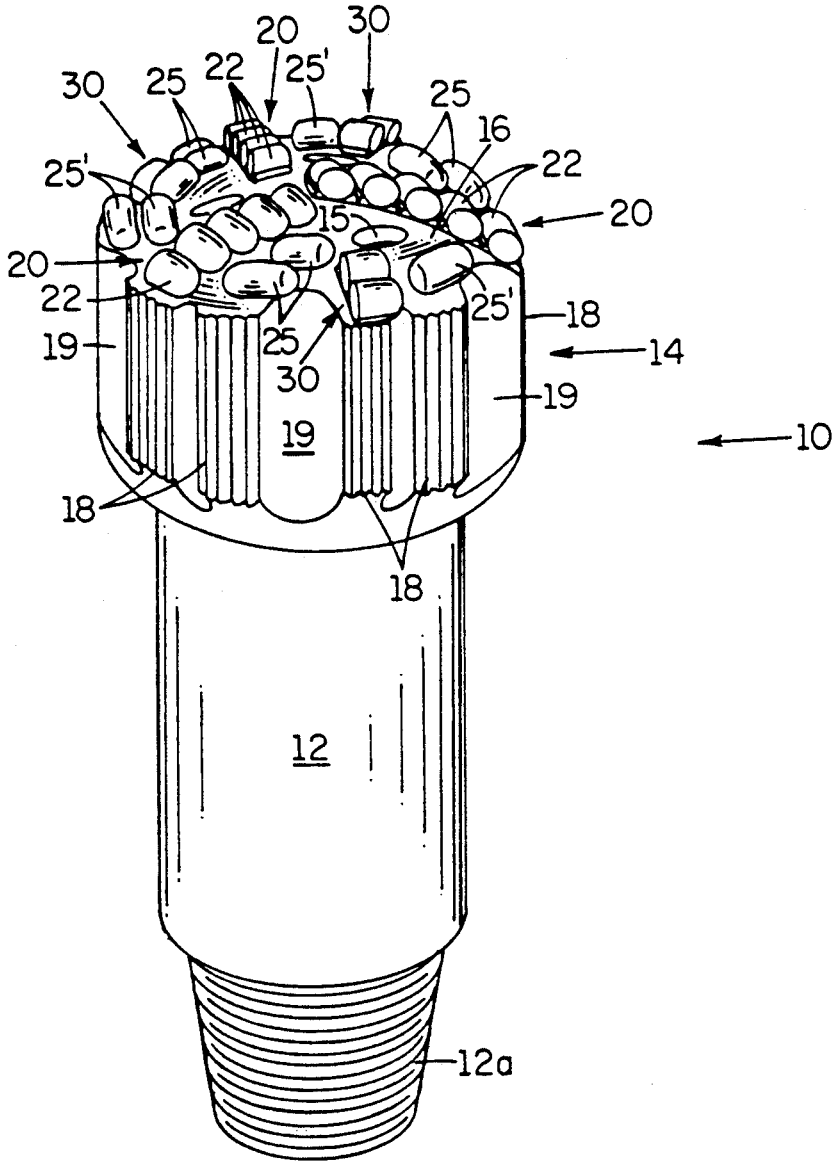
FIG. 2 is a perspective view of a drill bit constituting a preferred embodiment of this invention.

As best shown in FIG. 2 a drill bit 10 embodying this invention comprises a generally cylindrical shank portion 12 terminating at one end in an externally threaded portion **12*a* for connection to a drilling motor or a well drilling string. The other end of the drill bit 10, namely that which is normally the bottom end, is radially enlarged to form a drilling head 14. The end face 16 of the drilling head 14 is of generally circular configuration but, as is well known in the art, may comprise a convex spherical surface 16 as illustrated in the drawings, or a planar, or a spherical concave segment, or a conical surface. In any event, a plurality of angularly spaced bores 14***a* are formed in the drilling head 14 and nozzles 15 are threaded in each such bore so as to provide drilling mud to the cutting surfaces of the cutting elements of the drill as will be hereinafter described.

Figure 1:
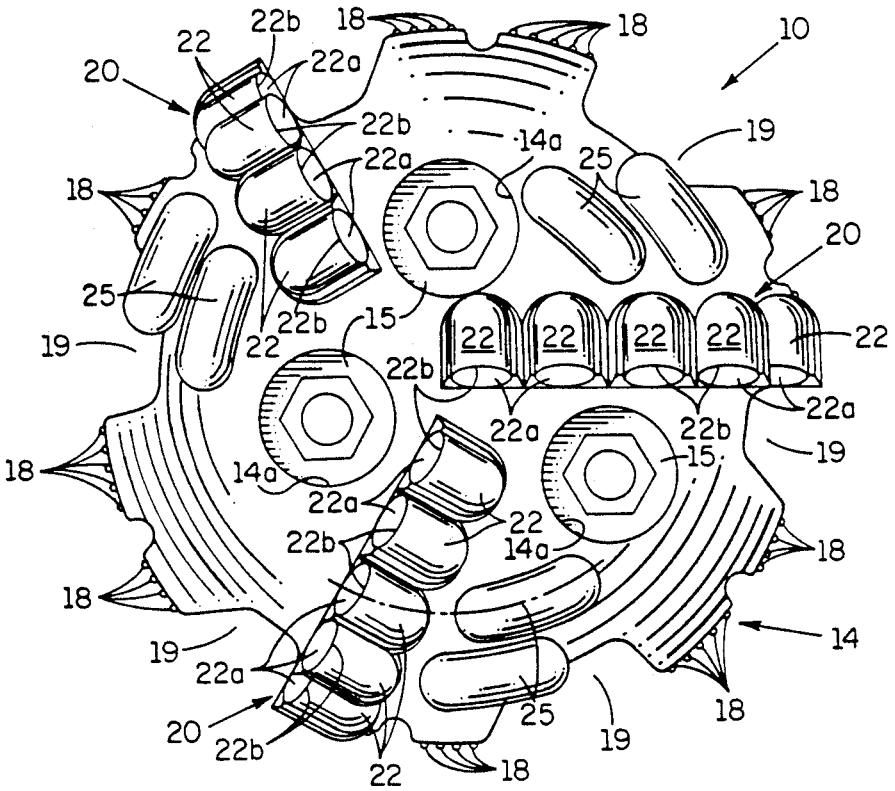
FIG. 1 is a schematic bottom elevational view of a rotary drill bit embodying this invention.

In the simplest embodiment of this invention shown in FIG. 1, three sets of primary cutting elements 20 are mounted on the end face 16 in 120°, angularly spaced relationship. Each set extends radially outwardly from a position adjacent the center of the end face 16 to the periphery of the drill, following the contour of the end face 16 which, in the particular example shown in the drawings is of a convex spherical segment configuration. Each set of cutting elements 20 comprises radially adjacent individual cutting elements 22 which are of conventional configuration and formed of conventional materials. Thus, cutting elements 22 may be formed of tungsten carbide or by a sintered mass of polycrystalline diamonds disposed in a suitable powder matrix to provide a PDC cutting element In either event, the cutting elements 22 are of any conventional configuration and are shown as a cylindrical configuration bonded along one side in grooves provided in the drill face 16, or are otherwise conventionally secured to end face 16. Each cutting element 22 has a circular cutting end face 22*a*. Thus, the cutting action is primarily performed by the outer semi-circular portions 22*b* of the cutting elements 22. As the drill is rotated and advanced by the drill string, the cutting edges 22*b* will cut a helical groove of generally semicircular cross-sectional configuration into the face of the formation.

In accordance with this invention, at least one stabilizing projection 25 is mounted immediately behind each set of cutting elements 20 with respect to the direction of rotation of such cutting elements. In the modification shown in FIG. 1, two such stabilizing projections 25 are formed on end face 16 behind each set 20 of primary cutting elements 22. Each stabilizing projection 25 is peripherally elongated in an arcuate configuration and is circumferentially aligned with one of the preceding cutting elements 22, as indicated by the dotdash line on FIG. 1. The external surfaces of the stabilizing projections 25 have the same cross-sectional configuration as cutting elements 22. Here the stabilizing projections are of rounded, non-cutting configuration and dimensioned so as to snugly enter into the helical groove cut by the respective circumferentially aligned primary cutting element. The height, however, of each stabilizing projection 25 relative to end face 16 is preferably somewhat less than the height of the cutting elements 22. Thus, the stabilizing projections 25 snugly enter and move along the groove produced by the respective circumferentially aligned cutting elements in frictional, but non-cutting relationship to the side walls of the helical groove produced by the respective cutting element circumferentially aligned with the particular stabilizing projection.

With this arrangement, any tendency of the drill bit 10 to be displaced in a radial direction through impact with a harder formation, or as a result of unbalanced forces operating on the drill bit in producing a directionally deviated hole, will be resisted and absorbed by the stabilizing projections 25. Thus vibration of the drill bit 10 is significantly reduced.

Figure 3:
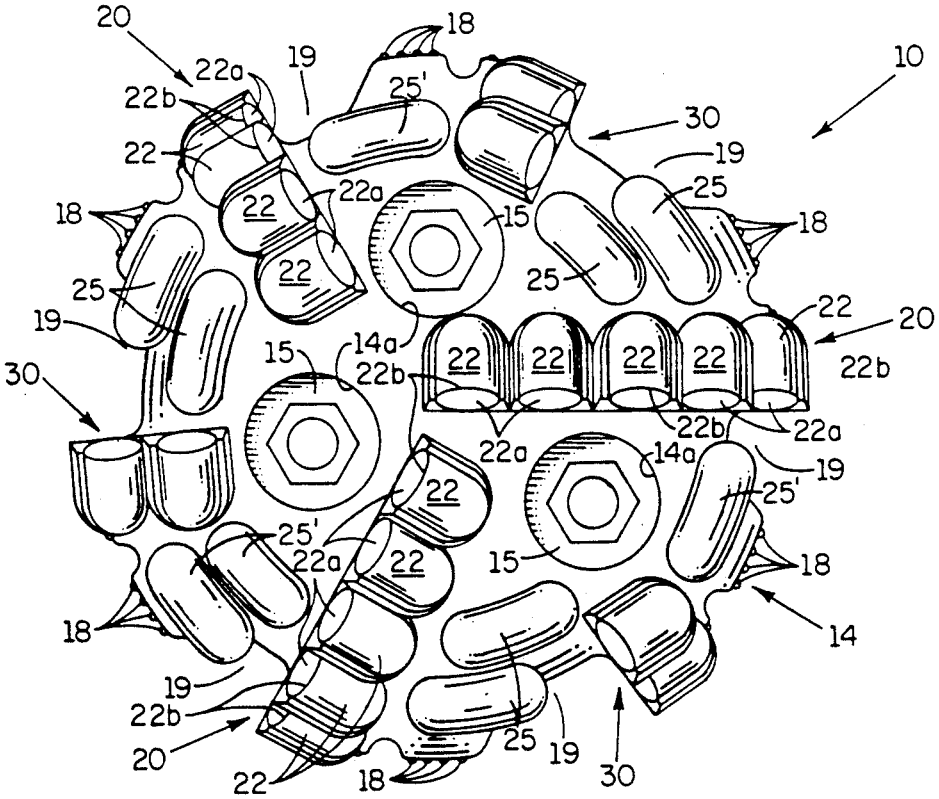
FIG. 3 is an enlarged scale bottom elevational view of the drill bit of FIG. 2.

Referring now to FIG. 3, which is a bottom view of FIG. 2, a further embodiment of this invention is shown wherein a plurality of sets of secondary cutting elements 30 are respectively mounted intermediate the sets of primary cutting elements 20 and disposed exteriorly of the bore holes 14*a*. These secondary cutting elements 30 are preferably of the same material and configuration as the primary cutting elements 22 and provide additional cutting action adjacent the periphery of the drill bit.

In accordance with this invention, at least one stabilizing projection 25' is provided behind and circumferentially aligned with one of the secondary cutting elements 30. These stabilizing projections 25' are configured and function in the same manner as those cooperating with the primary cutting elements. By being of peripherally elongated arcuate configuration and circumferentially aligned with one of the secondary cutting elements 30, the stabilizing projections 25' provide additional resistance to a radial displacement or vibration of the drilling bit.

Every drilling bit is, of course, provided with gauging or reaming cutters on its side wall and a conventional form of such cutters is schematically illustrated in FIG. 2 as comprising a plurality of peripherally spaced, axially extending rows of projections 18 containing polycrystalline diamonds separated by junk slots 19.

From the foregoing description, those skilled in the art will recognize that the provision of impact absorbing or stabilizing, peripherally extending, non-cutting arcuate projections on the face of the drill bit which are circumferentially aligned with a cutting element, and have a similar radial cross-section as the aligned cutting element, so as to enter and snugly engage the formation groove produced by the aligned cutting element, provides a positive resistance to a lateral displacement or vibration of the drill bit without in any manner reducing the efficiency of the drilling action.

What is claimed and desired to be secured by Letters Patent is:

1. A rotary drill bit for use in drilling well bores in subterranean formations comprising:

a bit body having a shank for connection to a rotatable drill string and an end face having a generally circular configuration;

a plurality of sets of primary cutting elements mounted on said end face in angularly spaced relationship relative to an axis of rotation;

each said set including a plurality of radially adjacent cutting elements extending radially outwardly from the central area of said end face to the perimeter of said end face;

at least one stabilizing projection on said bit body disposed angularly behind each set of cutting elements when the drill is operating;

each said stabilizing projection having a peripherally elongated, non-cutting, outer surface defining a lug positioned to snugly enter and engage the formation groove cut by a specific cutting element of the respective set of cutting elements located ahead of said stabilizing projection when said drill bit is rotated to drill through a subterranean formation.

2. The rotary drill bit of claim 1 further comprising:

a plurality of sets of secondary cutting elements disposed intermediate said sets of primary cutting elements and adjacent the periphery of said end face; 30 at least one supplemental stabilizing projection on said bit body disposed angularly behind each said set of secondary cutting elements;

each said supplemental stabilizing projection having a peripherally elongated, non-cutting outer surface defining a lug positioned to snugly enter and engage the formation groove cut by a specific cutting element of the set of secondary cutting elements located ahead of said stabilizing projection when said drill bit is rotated to drill through a subterranean formation.

3. The rotary drill bit of claim 1 wherein the cross-sectional configuration of each said stabilizing projection corresponds to the cross-sectional configuration of said specific cutting element.

4. A rotary drill bit for use in drilling holes in subterranean formations comprising:

a bit body having a shank for connection to a rotatable drill string and an end face having a generally spherical segment configuration;

said end face defining three bores for drilling fluids spaced 120° apart about the axis of rotation;

three sets of primary cutting elements respectively mounted on said end face respectively between said bores and respectively extending radially from the central region of said end face to the periphery of said end face;

three pairs of peripherally elongated stabilizing projections respectively formed intermediate said three sets of primary cutting elements on said end face and respectively disposed radially outside said three bores;

each pair of said three pairs of stabilizing projections being respectively circumferentially aligned behind two of said primary cutting elements so as to follow the paths of said two primary cutting elements during the drilling operation;

each said stabilizing projection having an external peripherally elongated surface shaped to continuously snugly engage the side walls of the formation groove produced by the respective aligned primary cutting element.

5. The rotary drill bit of claim 4 further comprising:

a plurality of sets of secondary cutting elements disposed intermediate said sets of primary cutting elements and adjacent the periphery of said end face;

at least one supplemental stabilizing projection on said bit body disposed angularly behind each said set of secondary cutting elements and circumferentially aligned with one of said secondary cutting elements;

each said supplemental stabilizing projection having an external peripherally elongated surface shaped to continuously snugly engage the side walls of the formation groove produced by the respective aligned secondary cutting element.

6. A rotary drill bit for use in drilling well bores in subterranean formations comprising:

a bit body having a shank for connection to a rotatable drill string and an end face having a generally circular configuration;

a plurality of sets of primary cutting elements mounted on said end face in angularly spaced relationship relative to an axis of rotation;

each said set including a plurality of radially adjacent cutting elements extending radially outwardly from the central area of said end face to the perimeter of said end face;

at least one stabilizing projection on said bit end face disposed angularly behind each set of cutting elements when the drill is operating and circumferentially aligned with one of said cutting elements;

each said stabilizing projection having an external, peripherally elongated surface shaped to continuously snugly engage the side walls of the formation groove produced by the respective aligned primary cutting element.

7. The rotary drill bit of claim 6 wherein the cross-sectional configuration of each said stabilizing projection corresponds to the cross-sectional configuration of said specific cutting element.

8. A rotary drill bit for use in drilling well bores in subterranean formations comprising:

a bit body having a shank for connection to a rotatable drill string and an end face having a generally circular configuration;

a plurality of cutting elements mounted in spaced relationship on said end face;

a number of stabilizing projections on said end face;

each stabilizing projection being circumferentially aligned behind a specific cutting element with respect to the direction of rotation;

each said stabilizing projection having an external, peripherally elongated surface shaped to continuously snugly engage the side walls of the formation groove produced by the respective aligned primary cutting element.

9. The rotary drill bit of claim 8 wherein the cross-sectional configuration of each said stabilizing projection corresponds to the cross-sectional configuration of said specific cutting element.

* * * * *

UNITED STATES PATENT AND TRADEMARK OFFICE

CERTIFICATE OF CORRECTION

PATENT NO. : 5,090,492

DATED : February 25, 1992

INVENTOR(S) : Carl W. Keith

It is certified that error appears in the above-identified patent and that said Letters Patent is hereby corrected as shown below:

Column 2, line 31, "elements The" should be -- elements. The --.

Column 3, line 24, "element In" should be -- element. In --.

Signed and Sealed this

Fourteenth Day of December, 1993

Bruce Lehman

*Attest:*

BRUCE LEHMAN

*Attesting Officer*

*Commissioner of Patents and Trademarks*